US005807842A

United States Patent [19]

Buscemi et al.

[11] Patent Number: 5,807,842

[45] Date of Patent: Sep. 15, 1998

[54] HYDROCARBON PROCESSING IN EQUIPMENT HAVING INCREASED HALIDE STREE-CORROSION CRACKING RESISTANCE

[75] Inventors: Charles D. Buscemi, San Francisco; John V. Heyse, Crockett, both of Calif.

[73] Assignee: Chevron Chemical Company, San Francisco, Calif.

[21] Appl. No.: 790,823

[22] Filed: Jan. 23, 1997

Related U.S. Application Data

[63] Continuation-in-part of Ser. No. 595,611, Feb. 2, 1996, abandoned.

[51] Int. Cl.[6] ..... C10G 75/00; C23F 11/00

[52] U.S. Cl. ..... 208/47; 208/48 R; 208/138; 208/139

[58] Field of Search ..... 208/133, 48 R, 208/48 AA, 47, 139, 137, 138

[56] References Cited

U.S. PATENT DOCUMENTS

| | | | |
|---|---|---|---|
| H544 | 11/1988 | Castillo et al. | 204/147 |
| 3,890,686 | 6/1975 | Caubet | 29/196 |
| 4,015,950 | 4/1977 | Galland et al. | 428/648 |
| 4,180,455 | 12/1979 | Taciuk | 208/126 |
| 4,325,994 | 4/1982 | Kitashima et al. | 427/423 |
| 4,329,173 | 5/1982 | Culling | 75/125 |
| 5,009,963 | 4/1991 | Ohmi et al. | 428/472.2 |
| 5,091,351 | 2/1992 | Murakawa et al. | 502/66 |
| 5,110,854 | 5/1992 | Ratliff | 524/439 |
| 5,139,814 | 8/1992 | Sugao | 427/46 |
| 5,279,998 | 1/1994 | Mulaskey et al. | 502/74 |
| 5,376,464 | 12/1994 | Dupoiron et al. | 428/679 |

(List continued on next page.)

FOREIGN PATENT DOCUMENTS

| | | |
|---|---|---|
| 498182A | 8/1992 | European Pat. Off. . |
| 356041363 | 4/1981 | Japan . |
| 59-193264 | 6/1984 | Japan . |
| 018502 | 1/1989 | Japan . |
| WO92/15653 | 9/1992 | WIPO . |

OTHER PUBLICATIONS

D.R. McIntyre et al., "Guidelines for Preventing Stress Corrosion Cracking in the Chemical Process Industries", Mar., 1985, MTI Publication No. 15., pp. 152–154; 176–180; 205–208; 250–251; 278.

D. Juvé–Duc et al., "Corrosion Behavior of an 18–10 Stainless Steel Protected by a Layer of Alloyed Ferrite" Corros. Prot. Offshore, Commun., Symp. Int., 1979, Translation provided.

R.A. Yeske, "Corrosion in the Pulp and Paper Industry", Process Industries Corrosion, NACE 1986, pp. 191–203.

G.H. Koch, "Localized Corrosion in Halides Other than Chlorides", MP/Jun. 1993, pp. 54–58.

(List continued on next page.)

*Primary Examiner*—Bekir L. Yildirim
*Attorney, Agent, or Firm*—Witta Priester

[57] ABSTRACT

A hydrocarbon conversion process wherein austenitic stainless steel portions that are subject to halide stress-corrosion cracking conditions, such as the colder portions of the process equipment including effluent coolers, knockout drums, accumulation drums, and piping low points, are provided with a protective layer having improved halide stress-corrosion cracking resistance. The method comprises applying a metal cladding, plating, paint or other coating to a stressed portion of austenitic stainless steel hydrocarbon conversion process equipment, optionally curing the coated steel to form intermetallic compounds to protect the steel portions; converting hydrocarbons utilizing a halided catalyst or under conditions where a halogen-containing compound is added or evolved or both; and subjecting the protected steel portion to halide stress-corrosion cracking conditions. A preferred coating material comprises tin, and preferably one or more intermetallic layers are provided to at least a portion of an austenitic stainless steel substrate to improve its stress-corrosion cracking resistance.

20 Claims, 2 Drawing Sheets

U.S. PATENT DOCUMENTS

| | | | |
|---|---|---|---|
| 5,397,652 | 3/1995 | Carey, II et al. | 428/610 |
| 5,405,525 | 4/1995 | Heyse et al. | 208/133 |
| 5,406,014 | 4/1995 | Heyse et al. | 208/134 |
| 5,472,593 | 12/1995 | Gosling et al. | 208/65 |
| 5,614,454 | 3/1997 | Galperin et al. | 502/66 |

OTHER PUBLICATIONS

Ullmann's Encyclopedia of Industrial Chemistry, 5th edition, vol. B1 "Corrosion", pp. 8–16 to 8–25.

D.R. McIntyre, "Environmental Cracking", Process Industries Corrosion, NACE 1986, pp. 21–30.

A. S. Krisher, "Austenitic Stainless Steels", Process Industries Corrosion, NACE 1986, pp. 415–426.

D. Duc et al., "Ferritic Transformation of an Austenitic Stainless Steel by Hot Dipping in Liquid Tin or Tin–Nickel Alloys", Journal of Crystal Growth 24/25, 1974, pp. 559–562.

J. Gutzeit et al., "Corrosion in Petroleum Refining and Petrochemical Operations", Metals Handbook 9th Ed., 1987, pp. 1262–1266.

"Corrosion and Corrosion Inhibitors", Kirk Othmer Encyclopedia, 3rd Ed., 1979, pp. 113–142.

P.D. Thomas, Hydrocarbon Processing, Aug. 1972, pp. 66–68.

S. Audisio, "Chemical Vapor Deposition of Tin on Iron or Carburized Iron", J. Electrochem. Soc., Oct. 1980, pp. 2299–2304.

HYDROCARBON PROCESSING IN EQUIPMENT HAVING INCREASED HALIDE STREE-CORROSION CRACKING RESISTANCE

RELATED CASES

This patent application is a Continuation-in-Part patent application of U.S. Ser. No. 08/595,611 filed Feb. 2, 1996, now abandoned, the contents of which are incorporated herein by reference in their entirety.

FIELD OF THE INVENTION

The present invention relates to improved techniques for hydrocarbon processing, particularly catalytic reforming, under low-sulfur conditions using a halided catalyst. More specifically, the invention relates to the discovery and control of halide stress corrosion cracking problems associated with using halided catalysts upstream of austenitic stainless steel processing equipment.

BACKGROUND OF THE INVENTION

Recently, low-sulfur, low-water systems for catalytic reforming have been successfully commercialized. These systems use highly selective large-pore zeolite catalysts, particularly platinum L-zeolite catalysts, to convert paraffins to aromatics. Commercialization has necessitated the use of special steels and steels having protective layers in order to prevent coking, carburization and metal dusting of the steel surfaces. These protective layers are provided on steel surfaces that are to be contacted with hydrocarbons at process temperatures, e.g., at temperatures between about 800°–1150° F. For example, a tin protective layer has been used; its use in the reactors and furnace tubes of a catalyst reforming reactor system operated at ultra-low sulfur levels has effectively reduced the rate of coke formation exterior to the catalyst particles. This coke would otherwise have resulted in massive coke-plugging and in reactor system shutdowns. These problems are described in Heyse et al., WO92/15653, where protective coatings, including tin coatings, are used to prevent carburization and metal dusting. In a preferred embodiment, Heyse et al., teach applying a tin paint to a steel portion of a reactor system and heating in hydrogen to produce a carburization-resistant intermetallic layer containing iron and nickel stannides. The reforming system of Heyse et al., is a high temperature, low sulfur and low water system. The reference neither teaches nor discloses the presence of aqueous phases, or the presence of halides, or the presence of halide stress-corrosion cracking conditions.

U.S. Pat. No. 5,406,014 Heyse et al. teaches that a double layer is formed when tin is coated on a chromium-rich, nickel-containing steel. Both an inner chromium-rich layer and an outer stannide layer are produced. The outer layer contains nickel stannides. In Col. 12, Heyse et al. note that when a tin paint was applied to a 304 type stainless steel and heated at about 1200° F., there resulted a chromium-rich steel layer containing about 17% chromium and substantially no nickel, comparable to 430 grade stainless steel.

Recently, a new class of Pt L-zeolite reforming catalysts have been discovered that appear to provide improved catalyst properties, such as long catalyst life. These catalysts are produced by treating L-zeolites with halogen-containing compounds, such as halocarbons; see for example U.S. Pat. No. 5,091,351 to Murakawa et al., or with ammonium salts, see EP 498,182A. The resulting catalysts are useful for preparing aromatic hydrocarbons such as benzene, toluene and xylenes from $C_6$–$C_8$ aliphatic hydrocarbons in high yield. Other related patents that disclose halided L-zeolite catalysts include U.S. Pat. Nos. 4,681,865, 4,761,512 and 5,073,652 to Katsuno et al.; U.S. Pat. Nos. 5,196,631 and 5,260,238 to Murakawa et al.

It has been discovered that some of these halided catalysts evolve HCl, HF or both upon reforming, especially during the first few weeks on-stream. These evolving hydrogen halide gases, in turn, can produce aqueous halide solutions in the cooler regions of the process equipment, for example, downstream of the reactors. Alternatively, aqueous halides can be produced during start-ups or shutdowns, when this downstream equipment is exposed to ambient moisture. Any austenitic stainless steel sections of this equipment that come in contact with aqueous halide solution are subject to halide stress-corrosion cracking and potentially catastrophic failure.

Halide stress-corrosion cracking is a unique type of corrosion. There are many different problems associated with steels that are all superficially designated as "corrosion". And there are hundreds of different solutions to these different corrosion problems. Each type of corrosion has a different mechanism, so the solution to one corrosion problem is not generally or predictably applicable to another corrosion problem. In other words, it is difficult to predict with any reasonable expectation of success whether a solution that is effective for one corrosion problem is likely to be effective when applied to another different corrosion problem.

The present invention is related to one particular type of corrosion—halide stress-corrosion cracking (SCC) of one particular type of steel, austenitic stainless steel (SS). The term "austenitic stainless steel" refers to a class of iron based steels typically containing 18 or more percent chromium, and sufficient austenizing elements (mainly nickel) to produce a austenitic (face centered cubic) metallurgical microstructure. Austenitic stainless steels (those containing typically 8–15% nickel and 16–20% chromium) are the class of steels most affected by halide SCC.

Halide SCC occurs when austenitic stainless steel is contacted with aqueous halide at temperatures above about 120° F. (such as 130°–230° F.), while also subjected to tensile stress. Halide SCC can occur, for example, when hot halide-containing solution (such as hot salt water) contacts a piece of bent austenitic stainless steel. It is believed that the cracks caused by halide SCC progress by electrochemical dissociation of the steel alloy in the aqueous halide solution.

The need to protect austenitic stainless steel from halide SCC is well known. Generally, if SCC conditions are to be encountered, a different type of steel or a special alloy, which is typically more expensive than austenitic stainless steel, is selected when the equipment is designed. Alternatively, process conditions can sometimes be modified so that that SCC does not occur (e.g., by operating at lower temperatures, or drying the process streams.) In other situations where the properties of stainless steel are required or highly desirable, means are employed to prevent SCC. For example, metal claddings or organic polymeric coatings are applied to the stainless steel; these eliminate contact of the steel with the halide environment. Alternatively, corrosion inhibitors are added to the aqueous halide solution. However, in some situations, for example in petroleum process retrofits or redesigns, these alternatives are neither practical nor economic.

Tin coatings have been used for many years to prevent certain types of corrosion. For example, in food storage and packaging, it has been quite common to use tin-plated cans.

Diffusion coatings containing tin have been tested for their ability to prevent halide SCC. For example, D. Juvé-Duc et al., discuss the corrosive behavior of austenitic 18-10 stainless steel protected by a layer of alloyed ferrite in Corros. Prot. Offshore, Commun., Symp. Int. (1979). A mixture of tin with 80% aluminum is applied to 18-10 stainless steel by a slurry coating technique which uses elemental powders and nitrocellulose at 1000° C. The mixed tin/aluminum system was tested for halide SCC and showed improved properties over uncoated steel at some pressures. At other pressures, for example at 400 MPa, the uncoated steel was better. This tin/aluminum system apparently gave mixed results.

Thus, there still exists a need to increase the halide SCC resistance of austenitic stainless steel, especially in hydrocarbon processing equipment downstream of reactors used in environments where halides are either added or evolved. The present invention fills this need among others.

SUMMARY OF THE INVENTION

In one broad aspect, the invention is a hydrocarbon conversion process which utilizes a halided catalyst or is operated under conditions where halogen-containing compounds are added, evolved or both. In this process, austenitic stainless steel portions of the hydrocarbon conversion process equipment which are to be subjected to halide stress-corrosion cracking conditions are provided with a coating, more preferably a coating having at least one intermetallic layer, which provides improved halide stress-corrosion cracking resistance.

In one embodiment, the invention is a hydrocarbon conversion process comprising:

a) applying a metal cladding, plating, paint or other coating to a stressed portion of austenitic stainless steel hydrocarbon conversion process equipment, optionally curing the coated steel to form an intermetallic layer, to protect said steel portions;

b) converting hydrocarbons utilizing a halided catalyst or under conditions where a halogen-containing compound is added or evolved or both; and c) subjecting the protected steel portion to halide stress-corrosion cracking conditions which comprise having aqueous halide present.

In general, the protected steel is not purposely subjected to halide SCC conditions, but rather this occurs when aqueous halide is in contact with austenitic stainless steel at temperatures above about 120° F., such as between about 130° and 250° F., more typically between about 150° and 230° F. (although temperatures can be as high as 320° F., depending on halide concentration and pressure). For example, these conditions may occur during start-up or shutdown of the conversion process.

In a preferred embodiment, the invention improves the halide—particularly the chloride—SCC resistance of austenitic stainless steel by providing an intermetallic layer on the steel surface, this layer having nickel from the stainless steel incorporated therein. In an especially preferred embodiment, this layer is a tin-containing intermetallic layer comprising a nickel-containing stannide. An underlayer of nickel-depleted steel is preferably also present. This combination of an intermetallic layer and a nickel-depleted underlayer is referred to herein as a duple layer.

In another broad aspect, the invention is the use of stainless steel portions of process equipment having intermetallic layers thereon for the purpose of preventing halide SCC when said steel portions are contacted with hot brine. Preferably the intermetallic layers comprise tin. In a preferred embodiment, the coated steel is cured at elevated temperatures in hydrogen to produce the intermetallic layers.

Among other factors, this invention is based on the observation that halided Pt L-zeolite catalysts evolve hydrogen halides during reforming, especially during start-up; these halides can cause halide SCC on austenitic stainless steel. And, we have unexpectedly found that providing a thin intermetallic stannide layer on stressed austenitic stainless steel prevents halide SCC, even under extremely severe corrosion conditions. For example, in one test a tin-protected steel having a 1 mil thick stannide layer did not crack even after 28 days at extremely high chloride concentrations; in contrast, unprotected steel cracked in 2 hours.

In another embodiment, the invention is a method of using an austenitic steel portion having an intermetallic, protective layer thereon, comprising the steps of providing processing equipment, which includes stressed austenitic steel portions, with an intermetallic, protective layer thereon; and contacting said portions with aqueous halide solution at halide stress corrosion cracking conditions, wherein said portions are protected against halide stress corrosion cracking by said intermetallic layer In a preferred embodiment, the invention is applied to catalytic reforming processes using a halided catalyst, especially where halogen-containing compounds are either evolved from or added to the reforming reactor system. Here, effluent gas comprising halogen-containing compounds can produce aqueous halide solutions in cool regions of process equipment or during process shutdowns. Thus, protection against halide SCC is needed. In an especially preferred embodiment, the invention is applied to ultra-low sulfur reforming using a halided platinum L-zeolite catalyst. Most preferred is the embodiment where such a catalyst is used to reform or dehydrocyclize a paraffin-containing naphtha feed having $C_6$, and/or C8 hydrocarbons to produce aromatics.

Reformers using conventional platinum (Pt) and Pt/Re catalysts are routinely subjected to regeneration procedures which use halogen-containing compounds, such as HCl, for catalytic metal redispersion. When dissolved in water to produce aqueous halide solutions, these halogens can cause the steel to crack at SCC conditions. For example, the halogens and acid halides typically used in these procedures can accumulate in aqueous environments in colder portions of the process equipment, such as in effluent coolers, knock-out drums and accumulation drums, as well as at low points in piping. Conventional reforming reactor systems solve this problem by using steels other than austenitic stainless steels, such as 2¼ Cr in those portions likely to be subject to halide SCC. However, sometimes stainless steel process equipment has been previously used for a different type of hydrocarbon processing, prior to its being put into service for reforming or the austenitic stainless steel is present for other reasons. In these types of retrofit situations, austenitic stainless steel may already be in place, and it is impractical or costly to replace it.

DETAILED DESCRIPTION OF THE INVENTION

Figure 1:
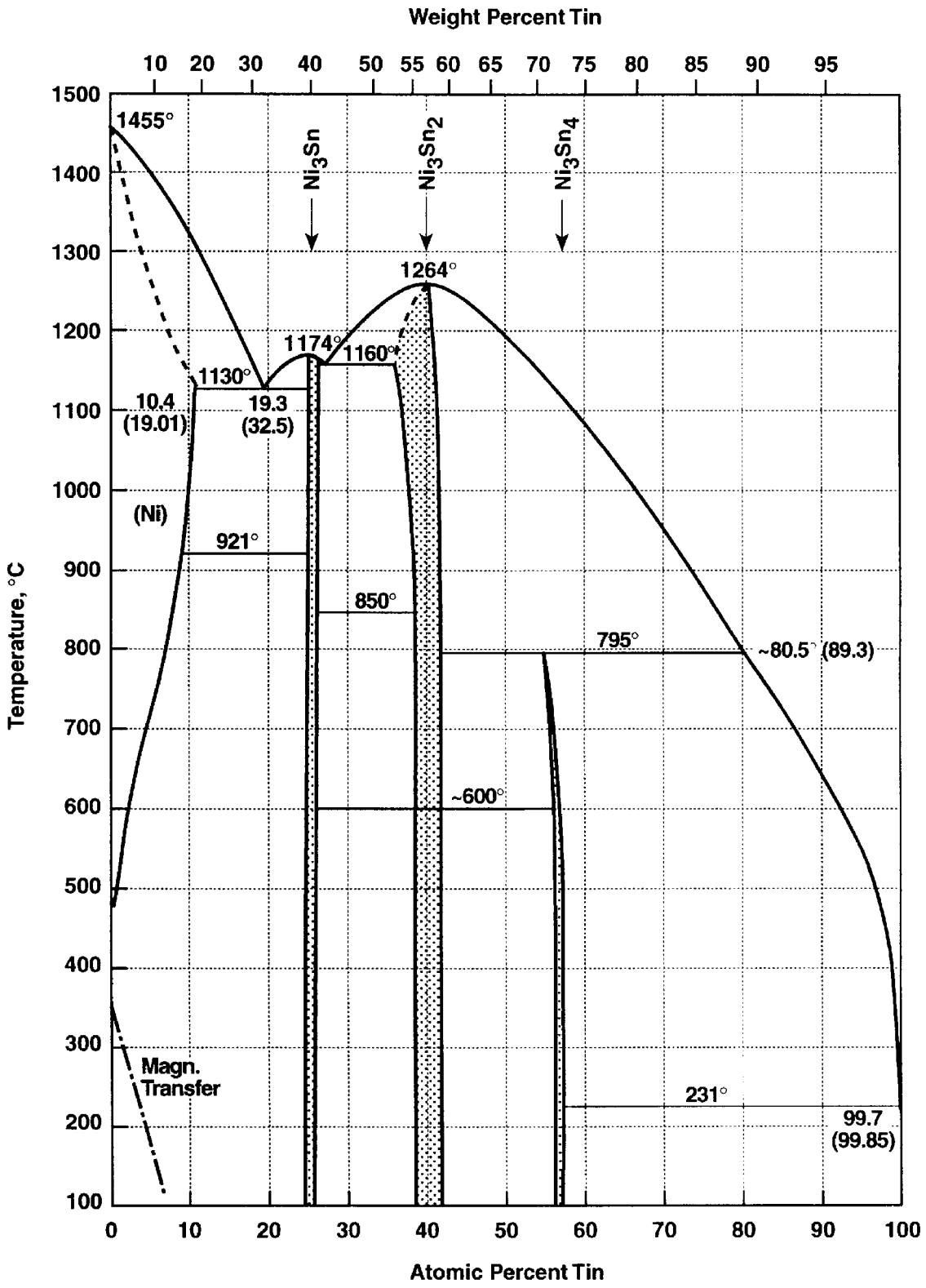
FIG. 1 is a nickel-tin phase diagram showing intermetallic nickel stannide phases.

In one embodiment, the invention is a hydrocarbon conversion process where halide SCC of austenitic stainless steel is prevented or reduced. A metal cladding, plating, paint or coating is applied to a stressed portion of a nickel-containing, austenitic stainless steel substrate; the coated steel is heated to a temperature sufficient to increase the SCC resistance of the steel by producing one or more intermetallic layer(s), said layer(s) preferably having nickel from the stainless steel incorporated therein; and the thus protected steel portions are then contacted by aqueous halide under SCC conditions without cracking.

Although discussed hereinafter in terms of providing tin-intermetallic layers, it is believed that germanium-, arsenic- and antimony-intermetallic layers will also reduce halide SCC, especially when these layers are produced under conditions of temperature and time such that nickel from the stainless steel is incorporated into the intermetallic layer. Thus, the discussion herein of tin-intermetallic layers is merely intended to exemplify a preferred embodiment, and is not intended to limit the invention to tin or tin intermetallics.

Although the terms "comprises" or "comprising" are used throughout this specification, these terms are intended to encompass both the terms "consisting essentially of", and "consisting of" in various preferred aspects and embodiments of the present invention.

As used herein the term "hydrocarbon conversion process equipment" or "process equipment" is intended to include equipment downstream of the reactors and furnace tubes of a hydrocarbon conversion reactor system. In particular, the process equipment includes the effluent coolers, knockout drums, accumulation drums, and various piping portions, especially the piping low points.

As used herein the term "austenitic stainless steel" means steel having an austenitic microstructure. These steels are well known in the art. Examples include 300 series stainless steels such as 304 and 310, 316, 321, 347. Austenitic stainless steels typically contain between 16–20% chromium and between 8–15% nickel. Steels with less than 5% nickel are ferritic and are not susceptible to halide SCC.

As used herein the term "intermetallic layer" means a layer on a steel substrate which contains two or more metals, the metals being present as intermetallic compounds, i.e., in compounds having a stoichiometric ratio of elements. This layer may vary in thickness and may contain irregularities, but this layer is substantially continuous and uninterrupted. Intermetallic compounds are well known in the art; they are more structured than molecular mixtures or alloys. Moreover, they have physical properties (such as color) and chemical properties that are unique to the intermetallic phase. As an example, consider an intermetallic stannide layer. It contains tin intermetallic compounds comprising tin and at least one other metal. The tin and the other metal(s) (such as Fe, Ni, or a mixture of Fe, Ni) are combined into distinct compounds, which have a stoichiometric ratio of elements; this ratio varies only within a narrow range.

Examples of tin intermetallic compounds useful in this invention include iron and nickel stannides such as $Fe_3Sn$, $FeSn_2$, FeSn, $Ni_3Sn_2$, $Ni_3Sn$, $Ni_3Sn_4$, and mixtures of these. Other examples include mixed metal intermetallic stannides, for example $(Fe,Ni)_xSn_y$ where Fe and Ni substitute freely for one another, but summed together are present in a stoichiometric ratio with the tin, so that x and y are whole numbers. FIG. 1 is a nickel-tin phase diagram showing the various intermetallics produced at various nickel to tin ratios and temperatures. The iron-tin phase diagram would look similar to FIG. 1 with similar stoichiometries for compounds comparing iron and tin.

The intermetallic layer preferably comprises intermetallic compounds with at least one metal selected from among tin, antimony, germanium, or arsenic; more preferably the layer comprises at least one metal selected from among tin, antimony, germanium; and most preferably it comprises tin intermetallics, e.g., it comprises or consists essentially of metal stannides. Preferably the intermetallic layer is provided on at least those portions of the stainless steel substrate that are physically at low points in the process equipment, i.e. places where aqueous halide is likely to collect, such as drains. Preferably the intermetallic layer is provided to substantially all the stainless steel that may be subject to contact with aqueous halide at SCC conditions.

Incorporating nickel from the stainless steel into the intermetallic layer results in a chromium-rich, nickel-depleted underlayer. This combination of layers (intermetallic and nickel-depleted) is referred to herein as a duple layer—i.e., there are at least these two layers. The term "duple layer" as used herein also includes a combination of layers having more than these two layers, for example, a combination of layers comprising two intermetallic layers and a nickel-depleted underlayer.

As used herein, the term "halogen" or "halogen-containing compounds" includes any compound that contains a halogen, especially volatile compounds. The term includes, but is not limited to, elemental halogen, acid halides, alkyl halides, aromatic halides, inorganic halide salts and halocarbons. Examples of halogen-containing compounds include HCI, $Cl_2$ and MeCl, benzyl chloride, $Cl_2$, and $NH_4Cl$; HBr, $Br_2$, MeBr, benzyl bromide and $NH_4Br$; $NH_4F$, HF, $F_2$, and MeF; HI, $I_{12}$, MeI, iodobenzene, and $NH_4I$; NaF, NaCl, NaBr, NaI, $MgCl_2$, $MgI_2$, KCI, KBr, KI and KF; and $CF_4$, $CF_3Cl$, $CF_2Cl_2$, $CFCl_3$, $CHFCl_2$, $CHF_2Cl$, $CHF_3$, $C_2F_2Cl_4$, $C_2F_4Cl_2$ and $C_2H_4F_2$.

It will be clear to the skilled worker, when viewed in context, what is meant by the term "halogen-containing compounds are either added or evolved". In general, what is meant is that the halogen-containing compounds are either added to the process, for example injected along with the feed, or are evolved from the reactor system or reaction zone, for example as products, by-products or undesired contaminants. Thus the halogen-containing compound may be a feed component, a reactant, a product derived from a catalyst or cocatalyst, an additive, an impurity, part of a regeneration or rejuvenation system, etc. In a preferred embodiment of the invention, at least a portion of the added or evolved halogen-containing compound is the source of the halide in the aqueous halide solution, more preferably at least a portion of the halide in said aqueous halide solution is derived from a halogen-containing compound upstream of the equipment being protected. More preferably, the source of the halide in the aqueous halide solution is a halided platinum-containing catalyst upstream of the protected equipment.

The terms "liquid" or "aqueous" or "solution" are used herein to connote the required phase for halide SCC, i.e. in contrast to the gaseous or solid phase. For halide SCC to occur, a hot aqueous environment with dissolved halide anion must be present. The halide concentration in the aqueous halide solution that results in SCC varies. Generally, the halide concentration is above about 50 ppm by weight for chlorides, which tend to be the most aggressive of the halides in terms of cracking austenitic stainless steel. The solution concentration of bromide or fluorides required to crack austenitic stainless steel is somewhat higher; e.g. above several hundred ppm by weight.

Typical halide SCC conditions include temperatures above about 120° F., such as about 130° and 250° F., more typically between about 130° and 230° F. (although temperatures can be as high as 320° F., depending on halide concentration and pressure). The halide most commonly encountered is chloride; but aqueous bromide, iodide and fluoride can cause SCC of austenitic stainless steel. The invention is effective in reducing SCC in these environments as well.

This cracking problem is more severe for tempered stainless steels that have been heat treated to between 700°–1400° F. during fabrication, in use, or during welding. These steels are known as "sensitized", and chromium carbides have precipitated at the grain boundaries; the steel readily cracks at these locations. Generally, it is preferred to anneal the steel to >1900° F. to dissolve these carbides, followed by rapid quench, e.g., with water where possible. This desensitizes the steel. If the steel has been "sensitized", intergranular cracks (along the metal grain boundaries) may be produced. Otherwise, the steel will generally crack transgranularly (across the metal grains).

It is believed that dissolved oxygen also plays a role in the rate of halide SCC. In the total absence of oxygen, halide SCC crack propagation can be arrested. Practically, SCC crack propagation can be slowed to very low rates at $O_2$ levels of 0.01 to 0.1 ppm (100–1000 ppb).

In a preferred embodiment, an intermetallic tin-containing layer is provided on to austenitic steel portion of a hydrocarbon conversion reactor system in-situ, (i.e., in place—for example after the steel has been fabricated into a knockout drum or piece of transfer piping) via painting and curing. Producing the layer in-situ helps ensure that additional stresses will not be applied to the steel after curing. In a preferred embodiment, the steel is part of a catalytic reforming reactor system that converts naphtha to aromatics using a halided platinum-containing catalyst, preferably a halided L-zeolite catalyst.

It was hoped that other metals that form nickel intermetallic compounds, such as indium and bismuth, would be useful in improving the halide SCC resistance of stainless steel. However, it was found that these metals do not react sufficiently with austenitic stainless steel, and therefore do not provide the desired protection from halide SCC.

The intermetallic layer is preferably anchored to the steel substrate through an intermediate carbide-rich, nickel-depleted bonding layer. Preferably the intermetallic stannide layer is nickel-enriched and comprises carbide inclusions, while the intermediate carbide-rich, nickel-depleted bonding layer comprises stannide inclusions. Preferably the carbide inclusions are continuous extensions or projections of the bonding layer as they extend, substantially without interruption, from the intermediate carbide-rich, nickel-depleted bonding layer into the stannide phase, and the stannide inclusions are likewise continuous, extending from the stannide layer into the intermediate carbide-rich, nickel-depleted bonding layer. The interface between the intermediate carbide-rich, nickel-depleted bonding layer and the nickel-enriched stannide layer is irregular, but is otherwise substantially without interruption.

In a preferred embodiment, the intermetallic layer comprises a duple layer on the steel surface, said duple layer comprising: (i) a first layer having at least one nickel-containing intermetallic compound; and (ii) a second nickel-depleted layer. This layer is a chromium, carbide-rich steel layer.

Intermetallic layers, such as tin intermetallic layers, useful in this invention can be of varying thickness; generally thin layers are preferred. It is preferred that the intermetallic layer(s) be sufficiently thick and uniform that they initially cover the stainless steel surface completely. These layers are preferably less than a couple of mils thick, preferably between about 1 and 25 microns, and more preferably between 2 and 10 microns. These thin layers can readily be produced and are less costly than thicker layers. Another advantage of thin layers is that they are less likely to fracture under thermal stress. The nickel depleted underlayer is preferably also thin. This layer is preferably less than a couple of mils thick, preferably between about 1 and 25 microns, and more preferably between 2 and 10 microns.

Also, it is desirable that the intermetallic layers at least initially be firmly bonded to the steel; this can be accomplished, for example, by curing at elevated temperatures. For example an applied tin paint can be cured in hydrogen at temperatures above about 800° F., such as at 1100° F. for 24 hours.

Iron bearing reactive paints are also useful in the present invention, but not preferred. The addition of iron to a tin containing paint should facilitate the reaction of the paint to form iron stannides thereby acting as a flux. However, iron does not facilitate the formation of the nickel-depleted layer.

Plating, cladding or coating stainless steel with a layer of metal, such as tin, and then heating at sufficiently high temperatures creates a double protective layer. This heating results in an inner chromium-rich layer, which is resistant to halide SCC, and an outer intermetallic layer, which is a barrier to halides. For tin, this duple layer is formed upon exposure to elevated temperatures, preferably above about 1000° F., more preferably between about 1050° F. and about 1500° F., and most preferably at temperatures of about 1100° F. The tin reacts with the steel to form iron-nickel (Fe,Ni) stannides, preferentially leaching nickel from the surface of the steel and leaving behind a layer of chromium-rich steel. In some instances, it may be desirable to remove the iron, nickel stannide layer from the stainless steel to expose the chromium-rich steel underlayer.

The intermetallic tin-containing layers preferably consist essentially of metal stannides; For example, they are preferably produced in the absence of lead. Lead is highly toxic, especially at elevated temperatures. It is an environmental hazard, so health and safety concerns are usually issues when lead is used. Moreover, lead does not react with stainless steel to produce intermetallics; rather it sloughs off the steel surface, requiring special clean-up procedures. Thus, the tin coating composition is preferably substantially lead-free. Additionally, in a preferred embodiment, the tin coating is preferably substantially aluminum-free.

These intermetallic layers are not believed to be sacrificial layers; they do not preferentially corrode instead of the steel. Sacrificial metal coatings are only useful for a limited time period, since they breakdown under use conditions to produce metal ions and electrons at the anode. On the other hand, producing an intermetallic layer having nickel from the stainless steel incorporated therein provides a barrier to corrosion in aqueous halide SCC environments. Having a nickel-depleted underlayer provides additional SCC resistance.

The intermetallic layer can be provided on the steel in a variety of ways. Preferably, it is provided by applying a metal cladding, plating, paint or coating to the steel. After the metal is applied to the steel surface, the intermetallic compound(s) are formed by heating. Preferably, at least one metal of the intermetallic layer comes from the steel substrate itself. Using tin as an example, the non-tin components of the intermetallic compounds are preferably provided in large part by the steel, i.e., the iron and nickel components of the stannides come from the steel; more preferably substantially all the non-tin components are provided by the steel. More preferably, all the nickel is provided by the steel, and the intermetallic layer is nickel-rich relative to the base stainless steel.

Tin and other metals can be applied to steel using methods well known in the art. These include electroplating, chemical vapor deposition, and sputtering, to name just a few. Preferred methods of applying these metals include painting and plating. Thereafter, intermetallic layers are produced by heat treating and in some instances reduction. Where practical, it is preferred that the tin be applied in a paint-like formulation (hereinafter "paint"). Such a paint can be sprayed, brushed, pigged, etc. on the surface of the stainless steel substrate. The metal or metal compounds contained in the plating, cladding or other coating are preferably cured under conditions effective to produce molten metals and/or molten metal compounds, which react with the nickel of the stainless steel and totally cover the base metallurgy. Germanium and antimony paints are preferably cured between 1200° F. and 1400° F. Tin paints are preferably cured at about 1100° F. for 2 to 24 hours. Preferred intermetallic layers such as those derived from paints, are preferably produced under reducing conditions. Reduction/curing is preferably done using a gas-containing hydrogen, more preferably in the absence of hydrocarbons.

Some preferred coatings and methods of applying them are described in U.S. Ser. No. 803,063 to Heyse et al., corresponding to WO 92/15653, which is incorporated herein by reference in its entirety. This application also describes preferred tin paint formulations which when heated to sufficiently high temperature produce preferred intermetallic tin layers comprising nickel-containing stannide and enriched in nickel relative to the base steel.

One preferred paint is a decomposable, reactive, tin-containing paint which reduces to a reactive tin and forms metallic stannides [e.g., iron stannides, nickel stannides, and mixed stannides such as nickel-containing stannides of formula $(Fe, Ni)_x Sn_y$] upon heating in a reducing atmosphere (e.g., an atmosphere containing hydrogen). One especially preferred tin paint contains at least four components or their functional equivalents: (i) a hydrogen decomposable tin compound, (ii) a solvent system, (ii) finely divided tin metal and (iv) tin oxide. As the hydrogen decomposable tin compound, organometallic compounds such as tin octanoate or neodecanoate are particularly useful. Component (iv), the tin oxide is a high-surface tin-containing compound which can sponge-up the organometallic tin compound, yet still be reduced to metallic tin.

Paints preferably contain finely divided solids to minimize settling. Finely divided tin metal, component (iii) above, is also added to insure that metallic tin is available to react with the surface to be coated at as low a temperature as possible, even in a non-reducing atmosphere. The particle size of the tin is preferably small, for example one to five microns.

In one embodiment, there can be used a tin paint containing stannic oxide, tin metal powder, isopropyl alcohol and 20% Tin Ten-Cem (manufactured by Mooney Chemical Inc., Cleveland, Ohio). Twenty percent Tin Ten-Cem contains 20% tin as stannous octanoate in octanoic acid or stannous neodecanoate in neodecanoic acid. When tin paints are applied at appropriate thicknesses, initial reduction conditions will result in tin migrating to cover small regions (e.g., welds) which were not painted. This will completely coat the base steel. Preferred tin paints form strong adherent coats upon curing.

As an example of a suitable paint cure for a tin paint, the painted steel can be reduced with a mixture of $N_2$ and $H_2$, the $H_2$ concentration preferably being greater than or equal to 50%. The temperature can be raised to 800° F. at a rate of 50°–100° F./hr. Thereafter the temperature can be raised to a level of 1100° F. at a rate of 50° F./hr, and held within that range for about 4 hr. Curing can also be achieved in pure $H_2$ at 1100° F. to 1200° F. for 2–24 hours.

Thus, in a preferred embodiment, the steel having a duple layer protecting it from halide SCC is or has been contacted with hydrogen or hydrocarbons under reducing conditions, and the intermetallic layer is or was provided by applying a tin paint, and heat curing as discussed hereinabove.

The invention is particularly applicable to processes using intermediate and/or large pore zeolite catalysts, especially those that operate at ultra-low sulfur conditions. By "intermediate pore size" zeolite is meant a zeolite having an effective pore aperture in the range of about 5 to 6.5 Angstroms when the zeolite is in the H-form. These zeolites allow hydrocarbons having some branching into the zeolitic void spaces and can differentiate between n-alkanes and slightly branched alkanes compared to larger branched alkanes having, for example, quaternary carbon atoms. Useful intermediate pore size zeolites include ZSM-5 described in U.S. Pat. Nos. 3,702,886 and 3,770,614; ZSM-11 described in U.S. Pat. No. 3,709,979; ZSM-12 described in U.S. Pat. No. 3,832,449; ZSM-21 described in U.S. Pat. No. 4,061,724; and silicalite described in U.S. Pat. No. 4,061,724. Preferred zeolites are silicalite, ZSM-5, and ZSM-11. An especially preferred Pt on zeolite catalyst is described in U.S. Pat. No. 4,347,394 to Detz et al.

By "large-pore size zeolite" is meant a zeolite having an effective pore aperture of about 6 to 15 Angstroms. Preferred large pore zeolites which are useful in the present invention include type L-zeolite, zeolite X, zeolite Y and faujasite. Zeolite Y is described in U.S. Pat. No. 3,130,007 and Zeolite X is described in U.S. Pat. No. 2,882,244. Especially preferred zeolites have effective pore apertures between 7 to 9 Angstroms. More preferably, the zeolite is a type L-zeolite.

The composition of type L-zeolite expressed in terms of mole ratios of oxides, may be represented by the following formula:

$$(0.9–1.3)M_{2/n}O:Al_2O_3(5.2–6.9)SiO_2:yH_2O$$

In the above formula M represents a cation, n represents the valence of M, and y may be any value from 0 to about 9. Zeolite L, its x-ray diffraction pattern, its properties, and methods of preparation are described in detail in, for example, U.S. Pat. No. 3,216,789, the contents of which is hereby incorporated by reference. The actual formula may vary without changing the crystalline structure. Useful Pt on L-zeolite catalysts also include those described in U.S. Pat. No. 4,634,518 to Buss and Hughes, in U.S. Pat. No. 5,196,631 to Murakawa et al., in U.S. Pat. No. 4,593,133 to Wortel and in U.S. Pat. No. 4,648,960 to Poeppelmeir et al., all of which are incorporated herein by reference in their entirety.

In a preferred embodiment, an alkali or alkaline earth metal is present in the large-pore zeolite. Preferred alkali metals include potassium, cesium and rubidium, more preferably, potassium. Preferred alkaline earth metals include barium, strontium or calcium, more preferably barium. The alkaline earth metal can be incorporated into the zeolite by synthesis, impregnation or ion exchange. Barium is preferred to the other alkaline earths because it results in a somewhat less acidic catalyst. Strong acidity is undesirable in some catalysts because it promotes cracking, resulting in lower selectivity. Thus for some applications, it is preferred that the catalyst be substantially free of acidity.

The zeolitic catalysts used in the invention are charged with one or more Group VIII metals, e.g., nickel, ruthenium, rhodium, palladium, iridium or platinum. Preferred Group VIII metals are iridium and particularly platinum. If used, the preferred weight percent platinum in the catalyst is between 0.1% and 5%. Group VIII metals can be introduced into zeolites by synthesis, impregnation or exchange in an aqueous solution of appropriate salt. When it is desired to introduce two Group VIII metals into the zeolite, the operation may be carried out simultaneously or sequentially.

In some applications, for example in ultra-low sulfur reforming using a non-acidic Pt L-zeolite catalysts, it is preferred that the feed to the catalyst be substantially free of sulfur. Ultra low sulfur levels are preferably below 100 ppb, more preferably below 50 ppb, most preferably below 25 ppb, with levels of sulfur below 10 ppb and especially below 5 ppb being especially preferred.

One preferred embodiment of the invention uses L-type zeolite catalysts treated with halogen-containing compounds. These types of catalysts have recently been disclosed. Preferred catalysts are prepared by treating L-zeolites with chlorine- and fluorine-containing compounds. For example, U.S. Pat. No. 5,091,351 to Murakawa et al., discloses treating a Pt L-type zeolite catalyst with a halogen-containing compound. The resulting halided catalyst has a desirably long catalyst life and is taught to be extremely useful for preparing aromatic hydrocarbons such as benzene, toluene and xylenes from $C_6$–$C_8$ aliphatic hydrocarbons in high yield. Other related patents that disclose halided L-zeolite catalysts include U.S. Pat. Nos. 4,681,865, 4,761,512 and 5,073,652 to Katsuno et al.; U.S. Pat. Nos. 5,196,631 and 5,260,238 to Murakawa et al. These patents are all incorporated herein by reference in their entirety. For processes such as catalytic reforming using a halided or halogen-containing catalyst, the coating must be stable to process conditions (e.g., to the presence of $H_2$) and to the free gaseous halogen-containing compounds such gaseous acid halides (e.g., HCl). We have observed that chloride and/or fluoride will evolve from these catalysts, for example during start-up. Moreover, it is believed that it may be necessary to inject halogen or halogen-containing compounds occasionally to maintain catalyst activity and/or selectivity. In these processes, the added and/or evolved halogen-containing compounds can also contribute to halide SCC, as aqueous halide solution can be produced or derived therefrom.

To obtain a more complete understanding of the present invention, the following examples illustrating certain aspects of the invention are set forth. It should be understood, however, that the invention is not intended to be limited in any way to the specific details of the examples.

EXAMPLE 1

Making U-Bend Test Specimens

ASTM G-30 describes the practice of making and using U-bend stress-corrosion test specimens. This method was used to prepare bent specimens from type 321 austenitic stainless steel(18% Cr, 10% Ni). The procedure involves cutting strips of the stainless steel sheet material, here 14 gauge steel, to approximately three inch lengths and bending around a small radius mandrel (typically about 5–20 mm depending on sample length and thickness) here 6 mm radius, until a 180° U-bend is formed.

EXAMPLE 2

Preparing Stannided Specimens

Pieces of 321 stainless steel, both bent and flat, were coated with a tin-containing paint. The paint consisted of a mixture of 2 parts powdered tin oxide, 2 parts finely powdered tin (1–5 microns), 1 part stannous neodecanoate in neodecanoic acid (20% Tin Tem-Cem manufactured by Mooney Chemical Inc., Cleveland, Ohio which contained 20% tin as stannous neodecanoate) mixed with isopropanol, as described in WO 92/15653. The coating was applied to the steel surface by painting and letting the paint dry in air. After drying, separate specimens of the painted steel were contacted with flowing hydrogen gas at, 900° F. (Specimen 2A) and 1050° F. (Specimen 2B) for 24 hours. The resulting intermetallic tin layers were examined visually for completeness of coating. Mounted and polished cross-sections of the materials when examined using petrographic and scanning electron microscopy. These techniques showed that tin intermetallic compounds, including nickel- and iron-containing stannides, are present at a thickness of between about 2 to 5 microns. A nickel depleted underlayer of a thickness of about 2–5 microns was also present in the Specimen 2B. The 900° F. curing procedure did not produce a duple layer.

EXAMPLE 3

Analysis of Steel having a Duple Layer

Samples were mounted in a clear epoxy resin and then ground and polished in preparation for analysis with the petrographic and scanning electron microscopes (SEM). If the microanalysis reveals two or more continuous layers on the steel, and the innermost layer (directly on the steel) is a metallic phase, and at least one outer layer is an intermetallic phase, then it is likely that a duple layer useful in this invention has been formed. SEM-BSE (back-scattered electron imaging) is especially effective for this analysis. To confirm that a duple layer is present, analysis by SEM-EDX (energy dispersive x-ray analysis) should show both a metal phase layer that is distinctly nickel depleted relative to the steel, and an intermetallic phase having stoichiometric compositions present (i.e., the intermetallic layer is not a random mixtures of metals).

EDX analysis can be used to determine the chemical composition of the layers. For example, tin intermetallic layers are analyzed for iron, nickel and tin. A general rule of thumb for tin (based on its phase diagrams) is that if the layer contains between about 10 and 80 mole % tin, this layer comprises intermetallics and is thus an intermetallic layer. For tin, compounds of formula $(Fe,Ni)_x Sn_y$ are produced. Calculating the Fe to Ni ratio allows one to determine if the stannide layer is nickel rich relative to the base stainless steel. The underlayer is analyzed for nickel, chromium and iron; if the layer has a lower nickel content (i.e., a lower wt % Ni) than the base stainless steel, it is nickel-depleted.

EXAMPLE 4

Chloride Stress-corrosion Cracking Test

Various samples were tested for chloride SCC susceptibility in 42% boiling $MgCl_2$. The test used was ASTM G-36.

This test provides an accelerated method of ranking the relative degree of SCC susceptibility for austenitic stainless steel in aqueous chloride-containing environments. Even materials that normally provide acceptable resistance in hot chloride service may crack in this test, as it is an extremely aggressive test. Materials that pass this test can be considered to be practically immune to halide SCC.

Distilled water was added to about 2 kg of reagent grade magnesium chloride ($MgCl_2$) in a 2000 ml Erlenmeyer flask. A thermometer and overhead condenser were added to the flask. The flask and contents were then heated on an electric hot plate. When the magnesium chloride solution boiled, it was adjusted to maintain the desired concentration and boiling point through the addition of small quantities of either water or $MgCl_2$. The test was performed using $MgCl_2$ solution at a constant boiling temperature of 155.0°±1.0° C. (311.0°±1.8° F.). After the solution had stabilized at 155° C., the stressed specimens were added. The specimens were given periodic inspections for the duration of the test, which lasted between 14–28 days. Test results for the tin specimens prepared in Example 2 are shown in Table 1. Specimens cured at 900° F. and 1050° F. gave the same results. Although both specimens have increased halide SCC resistance, it is believed that specimen 2A is somewhat more susceptible to cracking than Specimen 2B.

TABLE 1

Chloride Stress-corrosion Cracking

| Specimen Type | Surface | Result |
|---|---|---|
| Flat | Bare | Not cracked |
| U-Bend | Bare | Cracked in 2 hr. |
| Flat | Tin Coated | Not cracked |
| U-Bend (bent prior to coating) | Tin Coated | Not cracked |

Figure 2:
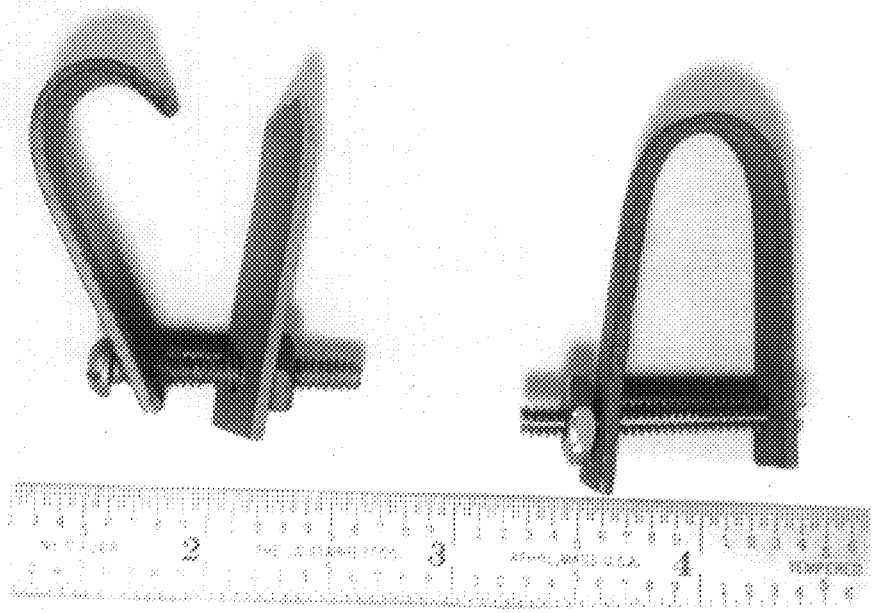
FIG. 2 is a photograph which shows test results comparing a failed and cracked bare type 321 stainless steel U-bend specimen (at left), and a type 321 stainless steel U-bend specimen (at right) having a tin intermetallic layer. The latter passed the boiling $MgCl_2$ test described in Example 4, below.

The results in this table show that the stannided steel prevented chloride SCC of the stressed (U-bend) specimen; in contrast the stressed bare steel cracked. FIG. 2 is a photograph showing the bare type 321 stainless steel U-bend specimen (at left) which cracked during this boiling $MgCl_2$ test, and the tin-coated type 321 stainless steel U-bend specimen (at right) which passed this test.

EXAMPLE 5

Antimonide Duple Layer

A four-component tin paint (as described in Example 2) was applied to a 347 stainless steel specimen. While the specimen was still wet, it was contacted with finely powdered antimony metal. Upon heating in a reducing atmosphere at 1300° F. for 1 hour, a 40 micron thick continuous layer containing (Fe, Ni) antimonide(s) was produced. A 10 micron thick nickel-depleted, chromium-rich, carbide-rich underlayer was also produced. The tin apparently did not react. This example shows that antimony, like tin, very effectively removes nickel from the steel to form a duple layer. Indeed, the antimony apparently reacted with the steel so aggressively that it precluded the steel reacting with the tin.

A U-bend specimen is prepared as described in Example 1. After being treated as described above, the specimen is tested for chloride SCC as described in Example 4. This antimonide duple layer increases the chloride SCC resistance of the stainless steel.

EXAMPLE 6

Making an Intermetallic Layer without a Nickel-depleted Underlayer

This example shows that curing a tin paint at temperatures below about 1000° F., such as at 900° F., results in an intermetallic stannide layer, but not in a duple layer.

A three-component tin paint containing (by weight) 4 part tin powder, 1 part $SnCl_2$ in a sufficient amount of 90 weight gear oil to have a spreadable consistency was applied to a 304 stainless steel specimen. The specimen was heated in flowing hydrogen gas at 900° F. for 2 hours. This procedure produced a 5 micron thick continuous intermetallic (Fe,Ni) stannide layer on the steel surface. Upon analysis it was found that this layer was not enriched in nickel relative to the base steel. Additionally, there was no indication that a nickel-depleted, chromium-rich, carbide layer was present.

EXAMPLE 7

Reforming Test

This example describes a preferred embodiment of the invention. A small catalytic reformer is to be operated at ultra-low sulfur reforming conditions using a halided platinum L-zeolite catalyst with a $C_6$–$C_8$ UDEX raffinate feed. The sulfur content of the feed contacting the catalyst is less than 5 ppb sulfur. The reactor system includes a sulfur converter/sulfur sorber, followed by four reforming reactors, their associated furnaces and furnace tubes. The reactors are made of 1¼ Cr-½ Mo steel. The furnace tubes are made of 304 stainless steel. The reactors, the furnace tubes and the associated piping of the reactor system are stannided as described in WO92/15653.

Stressed austenitic steel portions of the process equipment that are downstream of the reformers and furnace tubes, especially the colder portions of the process equipment which includes the effluent coolers, knockout drums, accumulation drums, and piping low points, are provided with a protective stannide layer having improved halide stress-corrosion cracking resistance. A tin paint is applied to these stressed portions of the equipment and heated to 1050° F. to produce a duple layer. The duple layer comprises a first layer containing a nickel stannide and a second nickel-depleted layer. The paint is applied to those surfaces where aqueous halide may accumulate. The paint consists of 1 part 20% Tin Ten-Cem (manufactured by Mooney Chemical Inc., Cleveland, Ohio), 2 parts powdered stannic oxide, 2 parts finely powdered tin metal (1–5 microns in size) and isopropyl alcohol (for flowability). The Tin Ten-Cem contains 20% tin as stannous octanoate in octanoic acid. After the paint is applied to a wet thickness of about 3 mils, the equipment is heated in a mixture of hot flowing hydrogen and nitrogen (1/9 ratio) for about 24 hours at 900° F. and then is maintained at about 1050° F. for about 48 hours. The painted surfaces now comprise iron and nickel stannides, including a duple layer. The tin migrates to cover small regions (e.g., welds) which are not painted.

A halided platinum L-zeolite catalyst is prepared in a manner similar to EP 498,182A1, Example 4. To 100 parts by weight of L-type zeolite, 20 parts by weight of a silica binder is added with mixing and kneaded and molded. This molded mixture is air-calcined at 500° C. (932° F.) for 2 hours to produce a molded L-zeolite with a silica binder. An impregnation liquid comprising 0.097 g of ammonium fluoride, 0.075 g of ammonium chloride, 0.171 g of platinum tetrammine chloride and 4.8 g of ion exchange water is prepared. This liquid is slowly dropped in 10 g of the molded L-type zeolite with stirring. The resulting zeolite was dried at room temperature overnight, then treated at 300° C. (572° F.) for 3 hours in the air. The calcination temperature and time should not be exceeded in order to limit platinum agglomeration. The calcined catalyst contains about 0.7 wt % F and 0.7 wt % Cl.

This catalyst is used to convert raffinate to aromatics at reforming conditions (temperatures between 800°–1000° F., pressures of 100 psi, hydrocarbon to hydrogen ratio of 5:1). It is observed that this halided catalyst evolves HCl. Fortunately, the downstream protected portions of equipment that are subjected to halide stress-corrosion cracking conditions do not show evidence of cracking.

While the invention has been described above in terms of preferred embodiments, it is to be understood that variations and modifications may be used as will be appreciated by those skilled in the art. Indeed, there are many variations and modifications to the above embodiments which will be readily evident to those skilled in the art, and which are to be considered within the scope of the invention as defined by the following claims.

What is claimed is:

1. A hydrocarbon conversion process wherein austenitic stainless steel portions of hydrocarbon conversion process equipment that are downstream of the reactors and furnace tubes and subject to halide stress-corrosion cracking conditions are provided with an intermetallic layer having improved halide stress-corrosion cracking resistance, the method comprising a) applying a metal cladding, plating, paint or other coating to a stressedportion of austenitic stainless steel hydrocarbon conversion process equipment that is downstream of the reactors and furnace tubes, optionally curing the coated steel to form an intermetallic layer, to protect said steel portions; and b) converting hydrocarbons utilizing a halided catalyst or under conditions where a halogen-containing compound is added or evolved or both, wherein the protected austenitic steel portion is exposed to halide stress corrosion cracking conditions, which comprise having aqueous halides present.

2. The process of claim 1 wherein said halide stress-corrosion cracking conditions comprise temperatures of between about 150° and 230° F.

3. The process of claim 1 wherein the protected steel portion is contacted with an aqueous halide solution at halide stress-corrosion cracking conditions during start-up or shutdown of said conversion process.

4. The process of claim 1 wherein the hydrocarbon conversion process is catalytic reforming.

5. The process of claim 1 wherein the reforming process is ultra-low sulfur reforming using a halided platinum L-zeolite catalyst.

6. The process of claim 1 wherein said intermetallic layer comprises a duple layer on the steel surface, said duple layer comprising: (i) a first layer having at least one nickel-containing intermetallic compound; and (ii) a second nickel-depleted intermetallic layer.

7. The process of claim 1 wherein a halogen-containing compound is evolved from a catalyst upstream of the protected steel equipment.

8. The process of claim 1 wherein the coating comprises at least one metal selected from among tin, antimony and germanium.

9. The process of claim 1 wherein an intermetallic layer is formed that consists essentially of metal stannides.

10. The process of claim 1 wherein the intermetallic layer comprises a nickel-containing stannide, wherein at least a portion of the added or evolved halogen-containing compound is the source of the halide in said aqueous halide solution, and wherein said protected steel shows a reduced crack growth rate or an increased initiation time for halide stress-corrosion cracking compared to unprotected stressed austenitic stainless steel when subjected to the same halide stress-corrosion cracking conditions.

11. The process of claim 1 wherein the equipment has been previously used in a hydrocarbon conversion process prior to preparing the intermetallic layer.

12. The process of claim 1 wherein the curing is done in a reducing environment comprising hydrogen and wherein said curing step is done at a temperature above about 1050° F.

13. The process of claim 1 wherein said halide stress-corrosion cracking conditions occur during start-up or shutdown of the hydrocarbon conversion process.

14. A method of using austenitic stainless steel having an intermetallic, protective layer thereon, said method comprising the steps of converting hydrocarbons in a hydrocarbon conversion apparatus that comprises process equipment, said process equipment including austenitic stainless steel portions, which are downstream of the reactors and furnace tubes and which have an intermetallic protective layer thereon; and contacting a protected austenitic stainless steel portion with aqueous halide solution at halide stress corrosion cracking conditions, wherein said portion is protected against halide stress corrosion cracking by said intermetallic layer.

15. The method of claim 14 wherein said portion is contacted with aqueous halide during start-up or shutdown of said hydrocarbon conversion process.

16. The method according to claim 14 wherein said halide stress corrosion cracking conditions comprise aqueous halides at temperatures of between about 150° and 230° F.

17. The method of claim 14 wherein the intermetallic layer comprises at least one metal selected from the group consisting of tin, antimony and germanium.

18. The method of claim 14 wherein the intermetallic layer comprises tin and is produced in a reducing environment.

19. The method according to claim 14 wherein said intermetallic layer comprises a duple layer which includes (i) a first layer having at least one nickel-containing intermetallic compound; and (ii) a second, nickel-depleted layer.

20. The method of claim 14 wherein at least a portion of the halide in said aqueous halide solution is derived from a halogen-containing compound that is derived from a hydrocarbon conversion catalyst located upstream of said process equipment.

* * * * *

UNITED STATES PATENT AND TRADEMARK OFFICE

CERTIFICATE OF CORRECTION

PATENT NO. : 5,807,842

DATED : September 15, 1998

INVENTOR(S) : Charles D. Buscemi and John V. Heyse

It is certified that error appears in the above–identified patent and that said Letters Patent is hereby corrected as shown below:

On the title page, and column 1, line 1

| | | |
|---|---|---|
| Title [54] | 3 | "STREE-CORROSION" should read --STRESS-CORROSION--. |
| 15 | 23 | "stressedportion" should read --stressed portion--. |

Signed and Sealed this

Twenty-fifth Day of May, 1999

*Attest:*

Q. TODD DICKINSON

*Attesting Officer*

*Acting Commissioner of Patents and Trademarks*